US007044670B2

(12) United States Patent
Delage

(10) Patent No.: US 7,044,670 B2
(45) Date of Patent: May 16, 2006

(54) APPLICATOR, AND A PACKAGING AND APPLICATOR DEVICE INCLUDING SUCH AN APPLICATOR

(75) Inventor: Jean-François Delage, Clamart (FR)

(73) Assignee: L'Oreal, Paris (FR)

( * ) Notice: Subject to any disclaimer, the term of this patent is extended or adjusted under 35 U.S.C. 154(b) by 106 days.

(21) Appl. No.: 10/729,917

(22) Filed: Dec. 9, 2003

(65) Prior Publication Data

US 2004/0131414 A1 Jul. 8, 2004

Related U.S. Application Data

(60) Provisional application No. 60/438,322, filed on Jan. 7, 2003.

(30) Foreign Application Priority Data

Dec. 10, 2002 (FR) ..... 02 15577

(51) Int. Cl.
*A46B 11/00* (2006.01)
*B43K 7/10* (2006.01)

(52) U.S. Cl. ..... 401/127; 401/126; 401/212; 401/214

(58) Field of Classification Search ..... 401/123, 401/124, 125, 126, 127, 212, 213, 214, 219
See application file for complete search history.

(56) References Cited

U.S. PATENT DOCUMENTS

| | | | | |
|---|---|---|---|---|
| 2,975,466 | A * | 3/1961 | Fillmore | 401/213 |
| 3,111,703 | A | 11/1963 | Kaufman | |
| 4,342,522 | A * | 8/1982 | Mackles | 401/214 |
| 5,851,077 | A | 12/1998 | Trejo | |
| 6,890,115 | B1 * | 5/2005 | Le Moing | 401/82 |

FOREIGN PATENT DOCUMENTS

| | | |
|---|---|---|
| EP | 0 506 564 A1 | 9/1992 |
| EP | 0 931 476 B1 | 8/2002 |
| FR | 2676339 | 11/1992 |
| FR | 2734131 | 11/1996 |

* cited by examiner

*Primary Examiner*—David J. Walczak
(74) *Attorney, Agent, or Firm*—Oliff & Berridge, PLC

(57) ABSTRACT

An applicator includes a handle member, a retainer secured to the handle member, an applicator ball rotably mounted in the retainer, and at least one elastically-deformable link element connecting the retainer to the handle member so that the retainer is moveable relative to the member. The handle member may be configured to be capable of closing a receptacle in a leaktight manner.

33 Claims, 2 Drawing Sheets

APPLICATOR, AND A PACKAGING AND APPLICATOR DEVICE INCLUDING SUCH AN APPLICATOR

This application claims the benefit of U.S. Provisional Application No. 60/438,322 filed on Jan. 7, 2003, the entire disclosure of which is incorporated by reference herein.

FIELD OF INVENTION

The present invention relates to applicators, such as applicators used in particular for applying cosmetics and care products.

BACKGROUND

U.S. Pat. No. 3,111,703 discloses a deodorant applicator comprising a receptacle having a cage fixed thereon that houses a ball. The cage has an end wall with a slit that is closed at rest. The end wall has two abutments disposed on either side of the slit and against which the ball comes to bear during application so as to exert stress on the abutments, causing the slit to open and allow the substance contained in the receptacle to pass to the ball.

French patent application No. 2,734,131 discloses a packaging and applicator device comprising a receptacle and a removable applicator element. The applicator element has a handle member defining a housing for a ball, which ball is urged towards the opening of the housing by a spring placed in the end of the housing.

SUMMARY OF THE INVENTION

Exemplary embodiments of the invention provide an applicator comprising a handle member and a retainer, such as a cage, secured to the handle member and defining a housing for receiving an applicator ball so as to allow the ball to rotate in the housing, wherein the retainer is movable relative to the handle member, the retainer being connected to the handle member by at least one elastically-deformable link element.

During application, embodiments of the invention may provide the user with a sensation of comfort by pressure exerted on the skin by the applicator being transmitted to the ball via the elastically-deformable link element.

In addition, during application, the ball can follow the relief of the body more easily, including the relief of the face, because of the way the retainer is movable relative to the handle member.

In embodiments, the link element may be made separately from the retainer, and assembled thereto during manufacture of the device. In other embodiments, at least part of the link element may be made integrally, e.g., monolithically, with the cage, for example, by molding of a plastics material.

When the handle member has an axis, e.g., an axis of symmetry of the applicator, the link element may be advantageously arranged so as to enable the retainer, at least during application, to move along the axis or to depart from the axis, for example, so as to allow the retainer to move in three mutually-orthogonal directions relative to the handle member.

In embodiments, the link element may comprise a foam, such as, for example, polyurethane foam. In other embodiments, the link element may comprise a spring, such as a helical spring. Where appropriate, the spring may be made integrally (e.g., monolithically) with the handle member, or with the retainer, or with both the handle member and the retainer, for example, by molding of a plastics material. The spring may also be made of metal. The link element may also be made of any other suitable material and/or configuration that is capable of being elastically deformed.

In embodiments of the invention, the handle member comprises a cap and an insert fixed within the cap, the link element being secured to the insert. The insert may optionally have an assembly skirt enabling the link element to be fixed thereto.

In embodiments of the invention, the applicator is arranged to be capable of closing, in sealed manner, a receptacle containing the substance for application. The applicator may include, for example, a sealing lip for pressing in leaktight or leakproof manner against a neck of the receptacle.

The retainer may be made of a plastics material that is relatively rigid, such as polyethylene or polypropylene, for example. The retainer may have an inside surface in the form of a portion of a sphere, for example, matching the shape of the ball.

The retainer and the ball may be configured to allow creation of a clearance therebetween that enables a movement of the ball in the retainer, other than a pure rotational movement, relative to the center of the retainer.

Embodiments of the invention provide a packaging and applicator device comprising: a receptacle suitable for containing a substance, for example, a cosmetic substance or other care product; and an applicator, as defined above, that is arranged to be capable of closing the receptacle.

In embodiments of the invention, the receptacle may have a wall defining a housing for receiving the ball when the applicator is in place on the receptacle.

This wall may also define a seat for the ball.

For example, in embodiments such a wall may include at least one annular portion against which the ball bears when the applicator is in place on the receptacle. This may serve to prevent the ball-receiving housing from filling too easily with substance while the device is being carried about, e.g., in a handbag.

In advantageous embodiments, when the applicator is in place on the receptacle, the link element may be compressed so as to press the ball against its seat. In embodiments, contact may be made between an edge of the retainer and the wall.

The wall may include one or more orifices allowing the substance contained in the receptacle to pass towards the ball. The orifice may open into a setback in the wall. This setback may be defined by the annular portion of the wall. The setback may co-operate with the ball to form a space suitable for retaining the substance. The space may make it easier for the ball to take up the substance.

The receptacle may be preferably made by assembling together a first portion forming a reservoir and a second portion defining a ball-receiving housing.

Exemplary embodiments of the invention provide a method of applying a substance using an applicator as described above, including: providing a substance to the applicator ball; contacting a surface with the applicator ball; moving at least one of the applicator and the surface relative to the other of the applicator and the surface while contacting the surface with the applicator ball to transfer at least some of the substance from the applicator ball to the surface; and allowing the retainer to move relative to the handle member during movement of the at least one of the applicator and the surface.

BRIEF DESCRIPTION OF THE DRAWINGS

The invention may be better understood on reading the following detailed description of non-limiting embodiments thereof, and on examining the accompanying drawings, in which.

DETAILED DESCRIPTION OF EXEMPLARY EMBODIMENTS

The term "care products" is used to generically refer to any substance that is used to effect one or more external body conditions, such as conditions of the skin, hair and nails. For example, such substances include, but are not limited to, treatment products, such as sunscreen, moisturizer and/or medicaments, cleansing products and cosmetic products, such as makeup products, or any other known or later developed product that may be applied to the body.

Figure 1:
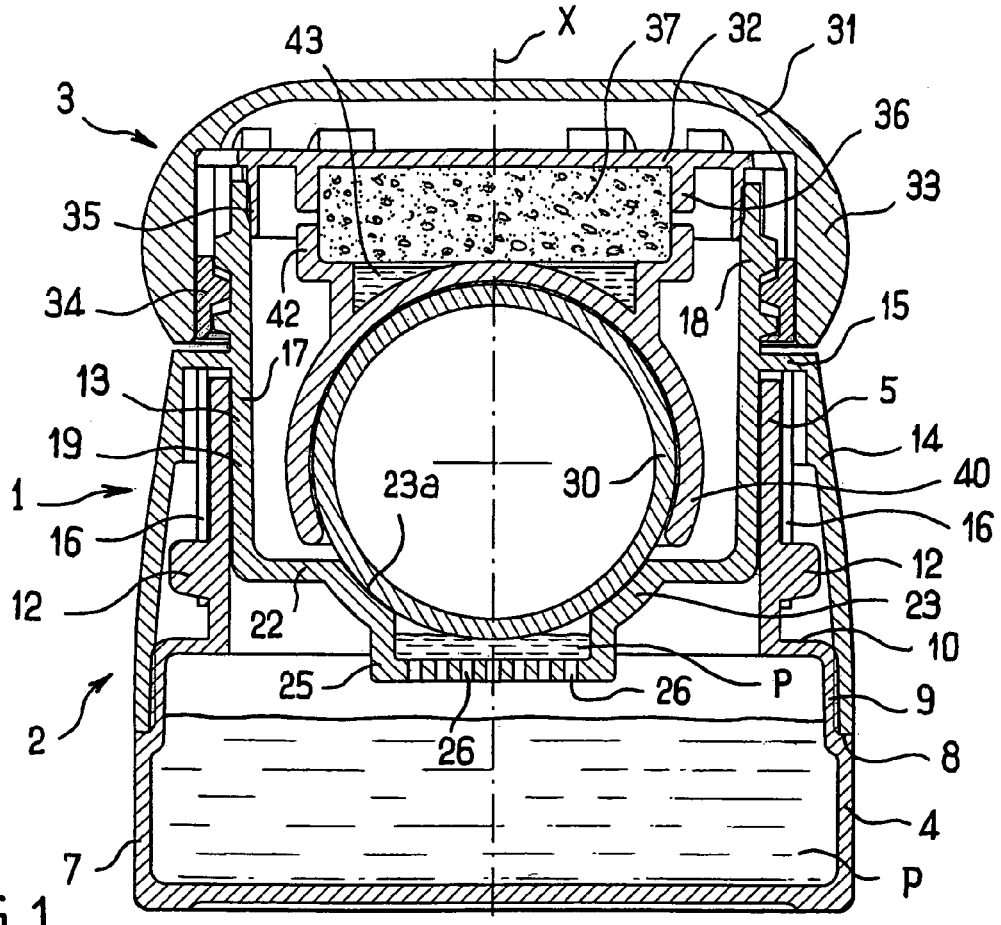
FIG. 1 is a diagrammatic and fragmentary axial section view of a first exemplary embodiment of a packaging and applicator device in accordance with the invention.
Figure 2:
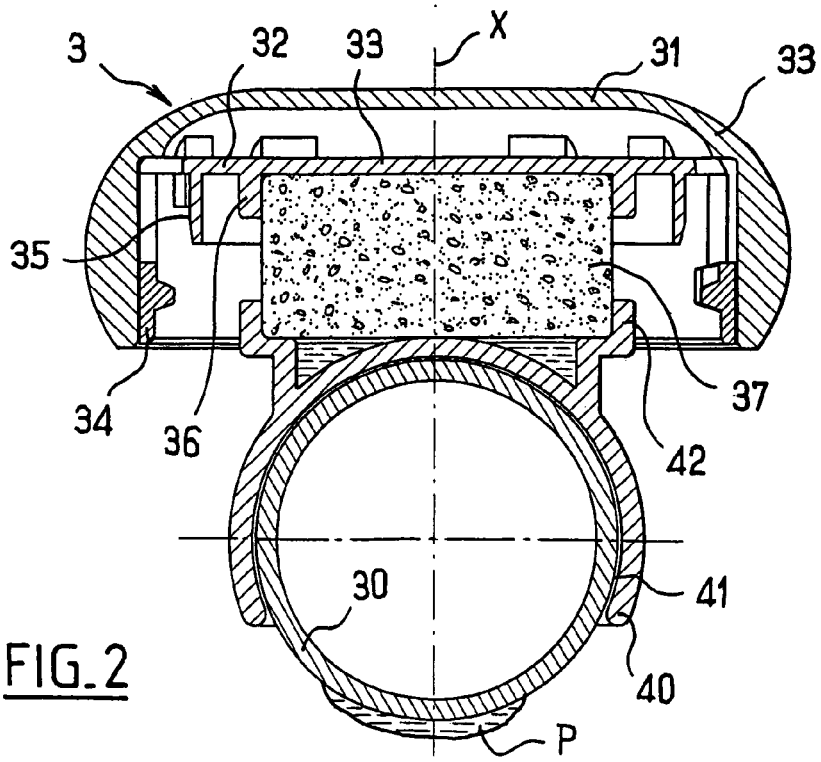
FIG. 2 is a diagrammatic axial section view showing an applicator of the device of FIG. 1.

FIG. 1 shows a packaging and applicator device 1 comprising a receptacle 2 and an applicator 3.

The receptacle 2 comprises a reservoir-forming first portion 4 containing a substance P, such as, for example, a body lotion. The first portion 4 may have a neck 5 at its upper end extending along an axis X.

The first portion 4 may also have an end wall 7 connected to the neck 5 via two successive shoulders 8 and 10.

The neck 5 may be provided on its outside surface with relief portions 12, which may provide a function that is explained below.

The receptacle 2 also comprises a second portion 13 formed by a part that may be fitted onto the first portion 4.

This second portion 13 may have an outer covering skirt 14 about the axis X with a bottom end that comes into abutment against the shoulder 8 and that snap-fastens onto an intermediate region 9 interconnecting the shoulders 8 and 10 of the first portion 4.

Inside the outer covering skirt 14, the second portion 13 may also comprise one or more ribs 16 extending in the direction of the axis X on either side of the relief portions 12 on the neck 5. The ribs 16 may be arranged to prevent the second portion 13 from turning relative to the first portion 4.

The outer covering skirt 14 may be connected to a wall such as a tubular wall 17 by a transverse region 15, which may, for example, extend perpendicularly to the axis X.

The wall 17 defines a neck 18 above the transverse region 15. The neck may have an outside thread and may bear in a leaktight manner via its bottom portion 19 beneath the region 15 against the inside surface of the neck 5 of the first portion 4.

A bottom end of the wall 17 may be closed by a bottom wall 22 which may comprise an annular region 23 with an upper surface 23*a* that is spherical so as to form a seat for an applicator ball 30 carried by the applicator 3, as described in detail below.

The bottom wall 22 may also have a setback 25 with a periphery that is connected to the annular region 23, with a concave side of the setback 25 facing towards the ball 30 and with its bottom wall being pierced by a plurality of orifices 26 that enable the substance P contained in the reservoir-forming portion 4 to reach the setback 25.

The applicator 3 may have a cap 31 in which an insert 32 is fixed. The assembly of the cap 31 and the insert 32 forms a handle member 33.

The insert 32 may have an outer skirt 34 with an inside thread that enables the applicator 3 to be screwed onto the neck 18 of the receptacle 2, a sealing lip 35 for pressing in a leaktight manner against the inside surface of the neck 18, and an inner skirt 36 that enables a link element 37 to be mounted on the insert 32 so as to connect the ball 30 to the handle member 33.

In the first exemplary embodiment, the link element 37 comprises a block of foam, such as, for example, polyurethane foam, fixed to the insert 32 by adhesive, for example. This block of foam may, for example, be substantially cylindrical in shape about the axis X.

The ball 30 is held while being capable of rotating within a retainer or cage 40 that defines a spherical housing 41 that allows a bottom region of the ball 30 to project for application purposes. The ball 30 may be put into place in the retainer 40 by deforming the retainer 40 elastically, for example.

In a top portion of the retainer 40, a fixing skirt 42 may be provided about the axis X. The fixing skirt 42 may have a shoulder that enables the fixing skirt 42 and/or the retainer 40 to be fixed to the link element 37, for example, by an adhesive 43.

In the first exemplary embodiment, the distance between the bottom edge of the inner skirt 36 and the top edge of the fixing skirt 42 is not zero, and is sufficient to enable the link element 37 to be compressed to a certain extent and also to enable the retainer 40 to move to some extent about axes of rotation that are mutually perpendicular and are perpendicular to the axis X.

When the applicator 3 is in place on the receptacle 2 as shown in FIG. 1, in order to close the device 1 in a leaktight manner, the link element 37 may be compressed and exert a force on the retainer 40 urging the ball 30 against the annular portion 23. Such contact between the ball 30 and the annular portion 23 tends to prevent the substance P from flowing from the first portion 4 beyond the space defined by the setback 25. The substance P may be retained therein by capillarity.

The exemplary device 1 may be used as follows.

A user turns the receptacle 2 over so as to enable the substance P to flow into the setback 25 through the orifices 26, which orifices 26 are permanently open in the first exemplary embodiment.

The ball 30 may then take up substance P.

Once the ball 30 has taken up the substance P, the user may separate the applicator 3 from the receptacle 2, for example, by unscrewing the applicator 3.

Figure 3:
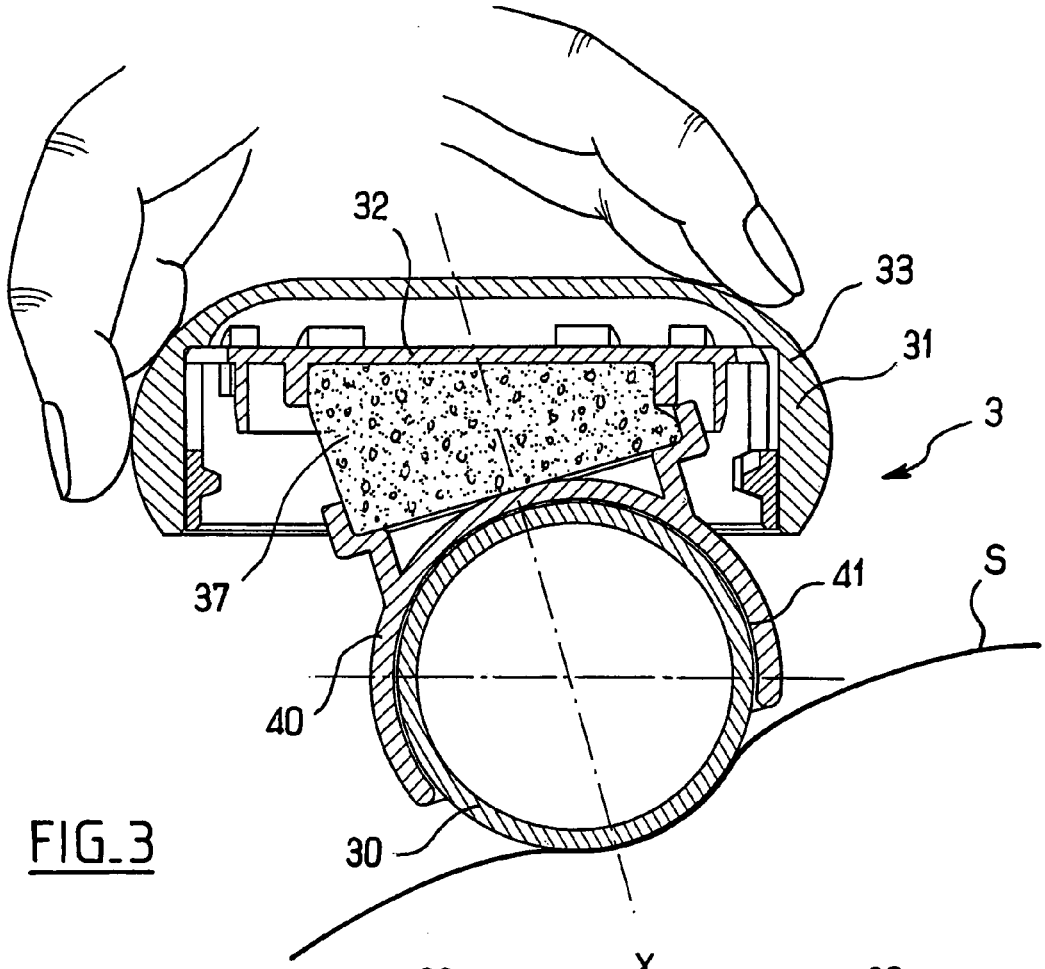
FIG. 3 is a diagrammatic view of the applicator of FIG. 2 during use.

During application, the user may cause the ball 30 to roll over skin S as shown in FIG. 3. As understood from FIG. 3, this may be accomplished by moving the applicator 3 relative to the surface of the skin S, by moving the surface of the skin S relative to the applicator 3, or moving both the applicator 3 and the surface of the skin S relative to each other. Because the link element 37 is capable of deforming, the link element 37 may deform as a function of the relief of the skin S, for example, as the applicator 3 is moved.

The ability of the ball 30 to move relative to the handle member 33 improves comfort during application.

The present invention also contemplates use of a link element other than a block of foam as shown in the first exemplary embodiment.

Figure 4:
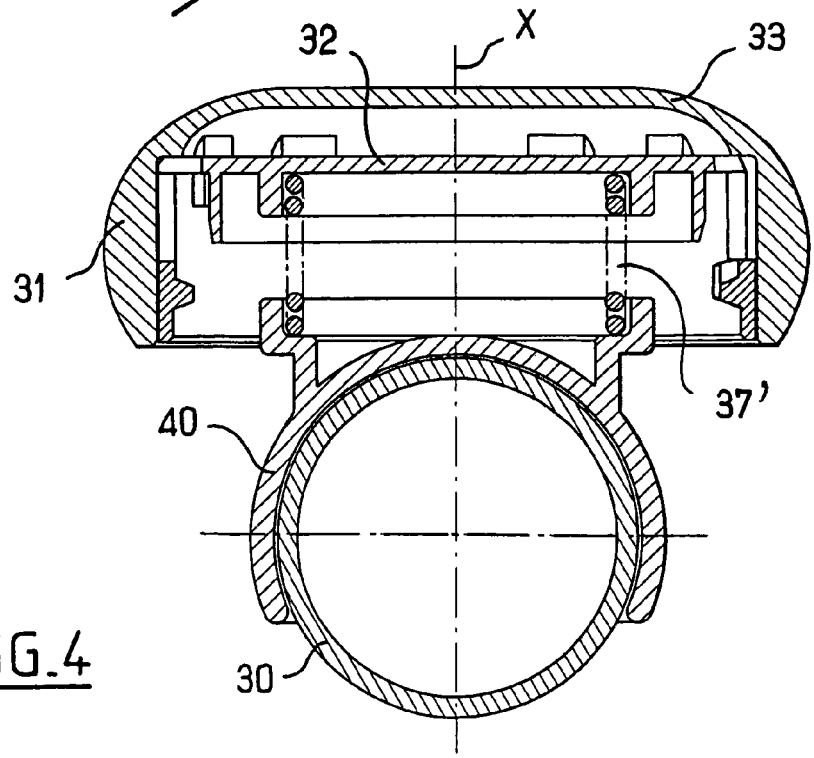
FIG. 4 is a diagrammatic axial section view showing an applicator according to a second exemplary embodiment of the invention.

FIG. 4 shows a second exemplary embodiment in which the retainer 40 housing the ball 30 is connected to the handle member 33 via a helical spring 37' disposed about the axis X.

This spring may be constituted by a separate piece as shown, or may be made by molding of a plastics material together with at least one of the retainer 40 and the insert 32.

Naturally, the invention is not limited to the embodiments described above.

For example, it is possible to make a receptacle that does not have a setback 25, with the annular portion 23 surrounding a single central opening through which the ball 30 can take up substance, for example.

The ball 30 may be flocked and/or may be made out of a variety of materials. In particular, the ball 30 may include a fill of particles for the purpose of having an effect on the substance or on the surface that is treated with the substance. This effect may be a magnetic field or may be a relief of some other substance, such as, for example, ions.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. In a device comprising a receptacle containing a substance, an applicator comprising:

a handle member;

a retainer secured to the handle member;

an applicator ball rotatably mounted in the retainer; and at least one elastically-deformable link element connecting the retainer to the handle member so that the retainer is moveable relative to the handle member, wherein the handle member is configured to close a receptacle.

2. The applicator of claim 1, wherein the handle member has an axis and the link element is configured to enable the retainer to move along the axis at least during application.

3. The applicator of claim 1, wherein the link element comprises a foam.

4. The applicator of claim 1, wherein the link element comprises a spring.

5. The applicator of claim 4, wherein the spring comprises a helical spring.

6. The applicator of claim 1, wherein the handle member comprises:

a cap; and an insert fixed in the cap, wherein the link element is secured to the insert.

7. The applicator of claim 6, wherein the insert comprises a skirt whereby the link element is secured to the insert.

8. The applicator of claim 1, wherein the handle member has a sealing lip for pressing against a neck of a receptacle.

9. The applicator of claim 1, wherein the retainer is made of a rigid plastics material.

10. The applicator of claim 1, wherein the retainer comprises a shape forming a portion of a sphere matching the shape of the ball.

11. The applicator of claim 1, wherein the link element is not integral with the retainer.

12. The applicator of claim 1, wherein the handle member is configured to close a receptacle in a leaktight manner.

13. A device, comprising:

a receptacle for containing a substance; and an applicator according to claim 1, the applicator being configured to close the receptacle when the applicator is in place on the receptacle.

14. The device of claim 13, wherein the receptacle comprises a wall forming a seat the ball.

15. The device of claim 14, further comprising a cosmetic substance contained in the receptacle.

16. The device of claim 14, wherein the wall has at least one annular portion against which the ball presses when the applicator is in place on the receptacle.

17. The device of claim 14, wherein the wall comprises at least one orifice that enables a substance contained in the receptacle to pass to the ball.

18. The device of claim 17, wherein the wall comprises a setback that co-operates with the ball when the applicator is in place on the receptacle to form a space into which the at least one orifice opens.

19. The device of claim 14, wherein the receptacle comprises:

a first portion forming a reservoir suitable for containing a substance; and a second portion assembled to the first portion, the second portion including the wall.

20. The device of claim 13, wherein the link element is compressed when the applicator is in place on the receptacle.

21. The device of claim 13, wherein the handle member has an axis and the link element is configured to enable the retainer to depart from the axis at least during application.

22. An applicator comprising:

a handle member having an axis;

a retainer secured to the handle member;

an applicator ball rotatably mounted in the retainer and allowing the retainer to move in a direction parallel to the axis and to depart from the axis at least during application; and a foam connecting the handle member to the retainer.

23. A method of applying a substance using the applicator of claim 22, comprising:

providing a substance to the applicator ball;

contacting a surface with the applicator ball;

moving at least one of the applicator and the surface relative to the other of the applicator and the surface while contacting the surface with the applicator ball to transfer at least some of the substance from the applicator ball to the surface; and allowing the retainer to move relative to the handle member during movement of the at least one of the applicator and the surface.

24. The method of claim 23, wherein providing a substance to the applicator ball comprises providing a care product to the applicator ball.

25. The method of claim 24, wherein providing a care product to the applicator ball comprises providing a cosmetic substance to the applicator ball.

26. An applicator comprising:

a handle member having an axis;

a retainer secured to the handle member;

an applicator ball rotatably mounted in the retainer; and a spring connecting the handle member to the retainer and allowing the retainer to move in a direction parallel to the axis and to depart from the axis at least during application.

27. A method of applying a substance using the applicator of claim 26, comprising:

providing a substance to the applicator ball;

contacting a surface with the applicator ball;

moving at least one of the applicator and the surface relative to the other of the applicator and the surface while contacting the surface with the applicator ball to transfer at least some of the substance from the applicator ball to the surface; and allowing the retainer to move relative to the handle member during movement of the at least one of the applicator and the surface.

28. The method of claim 27, wherein providing a substance to the applicator ball comprises providing a care product to the applicator ball.

29. The method of claim 28, wherein providing a care product to the applicator ball comprises providing a cosmetic substance to the applicator ball.

30. The applicator of claim 26, wherein the spring comprises a helical spring.

31. A method of applying a substance using the applicator of claim 1, comprising:

providing a substance to the applicator ball;

contacting a surface with the applicator ball;

moving at least one of the applicator and the surface relative to the other of the applicator and the surface while contacting the surface with the applicator ball to transfer at least some of the substance from the applicator ball to the surface; and allowing the retainer to move relative to the handle member during movement of the at least one of the applicator and the surface.

32. The method of claim 31, wherein providing a substance to the applicator ball comprises providing a care product to the applicator ball.

33. The method of claim 32, wherein providing a care product to the applicator ball comprises providing a cosmetic substance to the applicator ball.

* * * * *